US009061740B2

(12) United States Patent
Henriksen

(10) Patent No.: US 9,061,740 B2
(45) Date of Patent: Jun. 23, 2015

(54) SYSTEM FOR LAUNCH AND RECOVERY OF A VESSEL

(75) Inventor: Henrich Henriksen, Tønsberg (NO)

(73) Assignee: H. Henriksen Mek. Verksted AS, Tønsberg (NO)

( * ) Notice: Subject to any disclaimer, the term of this patent is extended or adjusted under 35 U.S.C. 154(b) by 0 days.

(21) Appl. No.: 13/882,020

(22) PCT Filed: Oct. 27, 2011

(86) PCT No.: PCT/NO2011/000304

§ 371 (c)(1),
(2), (4) Date: May 17, 2013

(87) PCT Pub. No.: WO2012/057633

PCT Pub. Date: May 3, 2012

(65) Prior Publication Data

US 2013/0220205 A1 Aug. 29, 2013

(30) Foreign Application Priority Data

Oct. 27, 2010 (NO) ..... 20101504

(51) Int. Cl.

| | |
|---|---|
| ***B63B 23/02*** | (2006.01) |
| ***B63B 35/44*** | (2006.01) |
| ***B63B 23/48*** | (2006.01) |
| ***B63B 23/52*** | (2006.01) |

(52) U.S. Cl.
CPC ..... *B63B 23/48* (2013.01); *B63B 23/52* (2013.01)

(58) Field of Classification Search
CPC .. B63B 35/40; B63B 2015/0058; B63B 15/02
USPC ..... 114/268, 322, 258, 259, 90, 91, 114/365–380
See application file for complete search history.

(56) References Cited

U.S. PATENT DOCUMENTS 4,049,287 A * 9/1977 Dudouyt ..... 280/213
5,378,851 A * 1/1995 Brooke et al. ..... 114/259

FOREIGN PATENT DOCUMENTS

FR 2683203 5/1993 ..... B63B 23/46

OTHER PUBLICATIONS

International Search Report and Written Opinion mailed Jan. 24, 2012 which issued in corresponding International Patent Application No. PCT/NO2011/000304 (9 pages).

* cited by examiner

*Primary Examiner* — S. Joseph Morano
*Assistant Examiner* — Andrew Polay
(74) *Attorney, Agent, or Firm* — Nixon Peabody LLP

(57) ABSTRACT

The present invention provides a system for launch and recovery of a vessel (1) from a host ship or platform (13), said host ship or platform comprising a lifting device (2) having at least one first lifting cable (9), characterized in that the vessel (1) comprises at least one fastening device (3), releasably connectable to said at least one first lifting cable (9), and at least one lifting winch (5) comprising a lifting winch cable (11), and at least one mast system comprising a mast (14) connected to at least one lifting winch (5) by one end of the corresponding lifting winch cable (11), said mast system being capable of raising the connected end of the lifting winch cable in a vertical direction. In addition, a vessel suitable for said system, and a method for launch and recovery of such a vessel, is provided.

19 Claims, 8 Drawing Sheets

SYSTEM FOR LAUNCH AND RECOVERY OF A VESSEL

CROSS-REFERENCE TO RELATED APPLICATIONS

This application is a U.S. national stage of International Patent Application No. PCT/NO2011/000304, filed Oct.27, 2011, which claims priority to Norwegian Patent Application No.20101504 filed Oct.27, 2010, the contents of which are each incorporated herein by reference in its entirety.

TECHNICAL FIELD

The present invention concerns a system for launch and/or recovery of unmanned water vessels from a ship or platform, a method for launch and/or recovery of such vessels, as well as such vessels adapted for said system.

BACKGROUND OF THE INVENTION

Unmanned water vessels, also termed USV (unmanned surface vessel) and UUV (unmanned underwater vehicles) are increasingly becoming more in demand for applications in for instance the offshore industry and military. USVs and UUVs are often launched and recovered from a mother vessel while at sea.

Safety is always a large concern during all types of launch and recovery of both manned and unmanned vehicles. Manned vehicles have the obvious advantage of having a person onboard which can perform the required connections between the vehicle and a mother vessel, while with unmanned vessels the recovery without a person onboard is more difficult. Many users of for example USVs and UUVs, today launch personnel with a rescue boat and then transfer them to the USV/UUV in open sea, this is a dangerous operation and should be avoided.

In the prior art various systems for launch and recovery of unmanned water vessels have been described.

U.S. Pat. No. 5,378,851 A disclose a system for launch and recovery of an unmanned vessel. The system comprises an automatic capture of a towing line and a crane with a cradle suitable for said vessel. The system requires a cradle specially adapted to the unmanned vessel that is used. The design of the unmanned vessel is also constrained by the need of a tower due to the specific method for capturing a towing line.

WO 2007/033384 A2 disclose a system for recovery of an unmanned water vessel. The system comprises a cable for capturing the vessel. Side planers are used to direct the capture cable out from a host vessel and into close contact with the unmanned vessel.

SUMMARY OF THE INVENTION

The main goal of the present invention is to provide a simple and effective system for launch and recovery of unmanned water vessel which removes the need of personnel onboard the USV/UUV during the launch or recovery phase of the USV/UUV operations, and which requires a minimum of robotics or advanced computer control except for that needed to navigate and steer the USV/UUV close to the host ship.

This is provided by a system, method and vessel as defined in the appended claims. In particular this invention provides a system and a method for launch and recovery of a smaller vessel from a host ship or platform. The system and/or method is suitable for unmanned surface vessels (USV), unmanned underwater vehicles (UUV), as well as any other manned and unmanned water vessels suitable for launch and recovery from a host ship or platform. Thus, the present invention provides the following:

A system for launch and recovery of a vessel from a host ship or platform, said host ship or platform comprising a lifting device having at least one first lifting cable, wherein the vessel comprises at least one fastening device, releasably connectable to said at least one first lifting cable, and at least one lifting winch comprising a lifting winch cable, and at least one mast system comprising a mast connected to at least one lifting winch by one end of the corresponding lifting winch cable, said mast system being capable of raising the connected end of the lifting winch cable in a vertical direction.

In a preferred embodiment of the system according to the invention, the vessel is an unmanned water vessel, preferably an USV (unmanned surface vessel) or UUV (unmanned underwater vehicle).

The invention also concerns a vessel for launch and recovery from a host ship, or platform, comprising at least one lifting winch, and at least one releasable fastening device, and at least one mast system connected to at least one lifting winch by a lifting winch cable, said mast system being capable of raising the connected end of a lifting winch cable in a vertical direction.

In one embodiment of the invention, the vessel comprises one fastening device and one lifting winch, mounted approximately at or above the center of gravity of the vessel.

In another embodiment of the invention, the vessel comprises one fastening device and one lifting winch mounted on one side of the center of gravity of the vessel, and one lifting winch and one fastening device are mounted at the opposite side, in a horizontal direction, of the center of gravity of the vessel.

In yet another embodiment of the invention, the mast system of the vessel comprises at least one mast having a first and a second end, the mast being connected to a lifting winch by a lifting winch cable, the lifting winch cable being fastened to the mast at a point closer to the first end than to the second end, the second end being mounted in a vertically pivotable manner on the vessel.

In yet another embodiment of the invention, the mast system of the vessel comprises a vertically extendable telescopic mast.

In yet another embodiment of the invention the fastening device of the vessel is an on-load hook or an off-load hook, preferably an off-load hook.

In yet another embodiment of the invention the vessel comprises a painter winch with a painter winch cable, and an on-load hook, both of which are mounted near the bow or stern, preferably the bow, of said vessel, the painter winch cable of the painter winch is preferably connected to the mast system or the lifting winch cable.

The invention also concerns a method for launching a vessel from a host ship or platform comprising the following steps:

- attaching at least one lifting cable, from a lifting device mounted on a host ship or platform, to at least one off-load hook on the vessel;
- attaching a painter line to a painter on-load hook on the vessel;
- lowering the vessel to the water surface, causing at least one off-load hook to release;
- activating the painter on-load hook when the vessel is ready.

The invention also concerns a method for recovering a vessel from a host ship or platform comprising the following steps:

maneuvering the vessel close to the host ship or platform;

activating a mast system, causing at least one lifting winch cable, connected to a lifting winch, and optionally a painter cable connected to a painter winch, to be raised;

manually capturing the at least one lifting winch cable, and optionally a painter winch cable;

optionally connecting a painter winch cable to a painter line, connected to the host ship or platform;

connecting the at least one lifting winch cable to at least one lifting cable from a lifting device mounted on the host ship or platform;

lifting the vessel out of the water using the lifting device.

BRIEF DESCRIPTION OF THE DRAWINGS

To provide a better illustration of the invention and its various features, a detailed description will be given below with reference to the appended drawings, in which.

DETAILED DESCRIPTION OF THE INVENTION

In the following, the invention is described in more detail by way of two specific embodiments. In the first embodiment, hereinafter referred to as a single point system, the water vessel is equipped with one lifting winch and one off-load hook. In this embodiment it is preferred to also equip the water vessel with a painter winch and a painter on-load hook in the stern or aft. In the second embodiment, hereinafter referred to as a twin point system, the water vessel has one lifting winch and one off-load hook mounted at one side of the center of gravity of the water vessel and one lifting winch and one off-load hook mounted at the opposite side of the center of gravity. Other embodiments, for instance comprising more than two sets of one lifting winch and one off-load hook, are envisioned.

Figure 1:
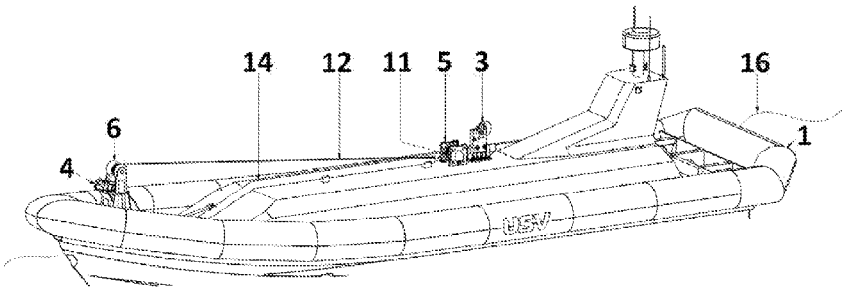
FIG. 1: Shows a vessel according to the invention having one lifting winch and one off-load hook.
Figure 2:
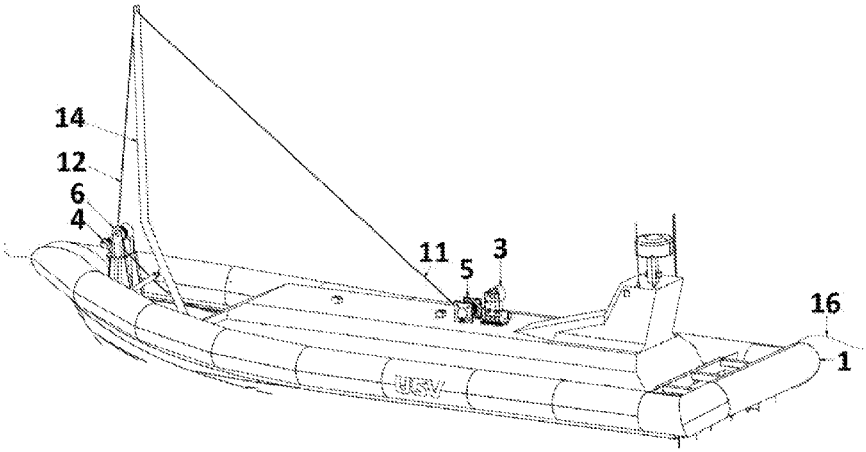
FIG. 2: Shows a vessel according to the invention having the mast system in a raised position.
Figure 3:
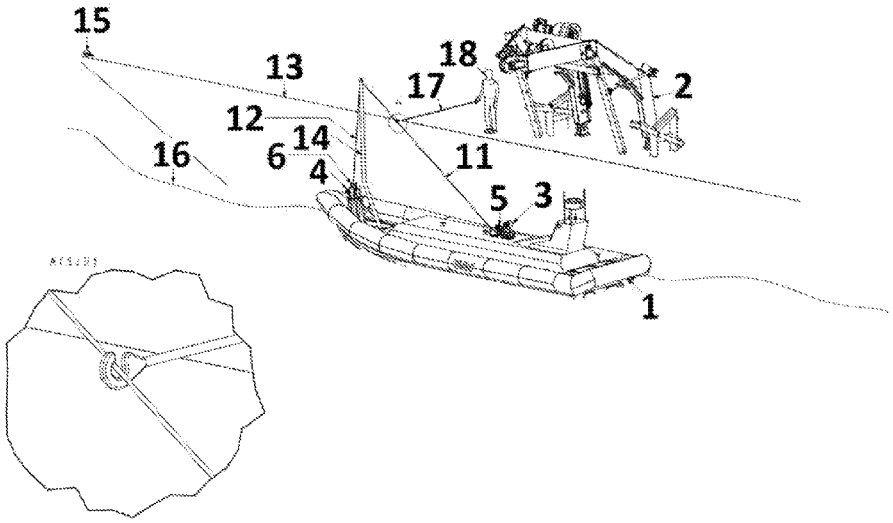
FIG. 3: Shows the recovery of a vessel, lifting winch cable being captured by a boat hook.
Figure 4:
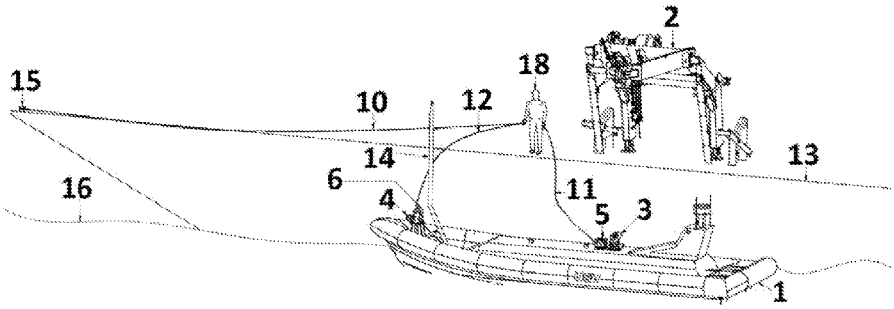
FIG. 4: Shows the recovery of a vessel.
Figure 5:
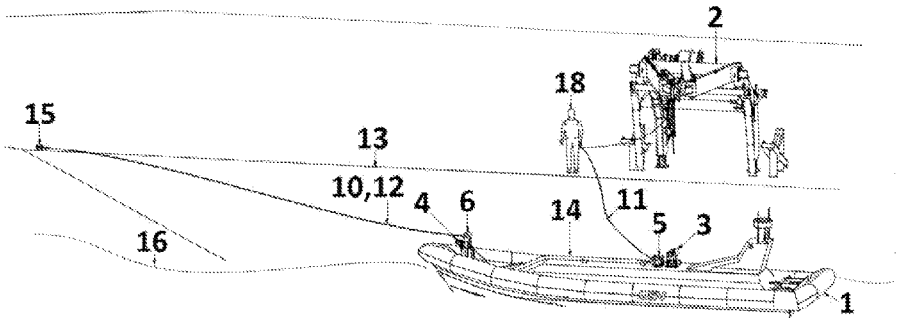
FIG. 5: Shows the recovery of a vessel.
Figure 6:
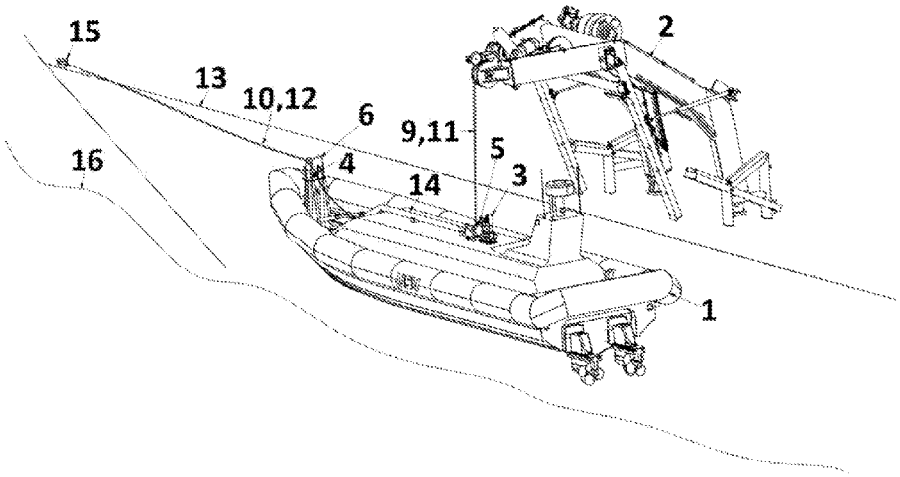
FIG. 6: Shows a vessel being lifted by a crane or davit.

The single point system, see FIG. 3-6 comprises a ship or platform (13) having a standard davit (2) or crane mounted on the deck, and a vessel (1) to be launched from, or recovered by, said ship or platform. The davit (2) or crane comprises a lifting cable (9), with a lifting ring (8), and a cradle. The vessel (1), see FIGS. 1 and 2, comprises a lifting winch (5), with a lifting winch cable (11) and an off-load hook (3), a painter winch (6), with a painter winch cable (12), and a painter on-load hook (4) mounted in the forward part of the vessel, and a mast (14).

Figure 7:
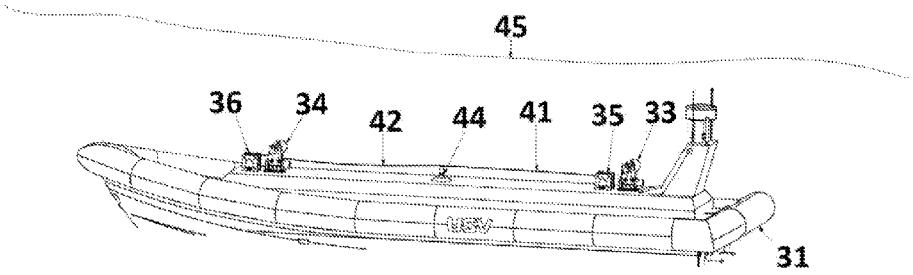
FIG. 7: Shows a vessel according to the invention having two lifting winches and two off-load hooks.
Figure 8:
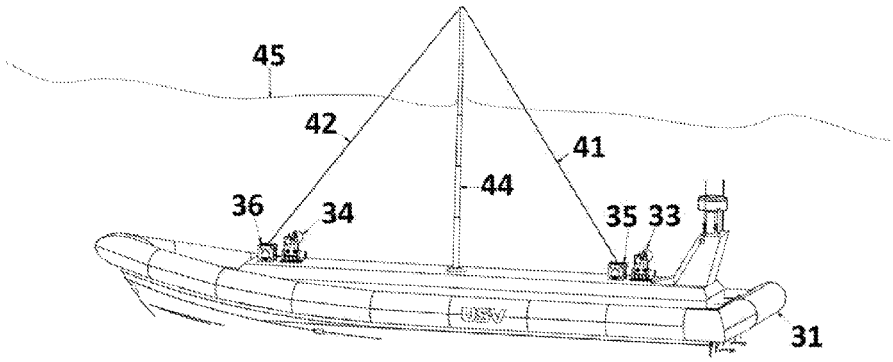
FIG. 8: Shows a vessel as illustrated in FIG. 7 having the mast system in a raised position.
Figure 9:
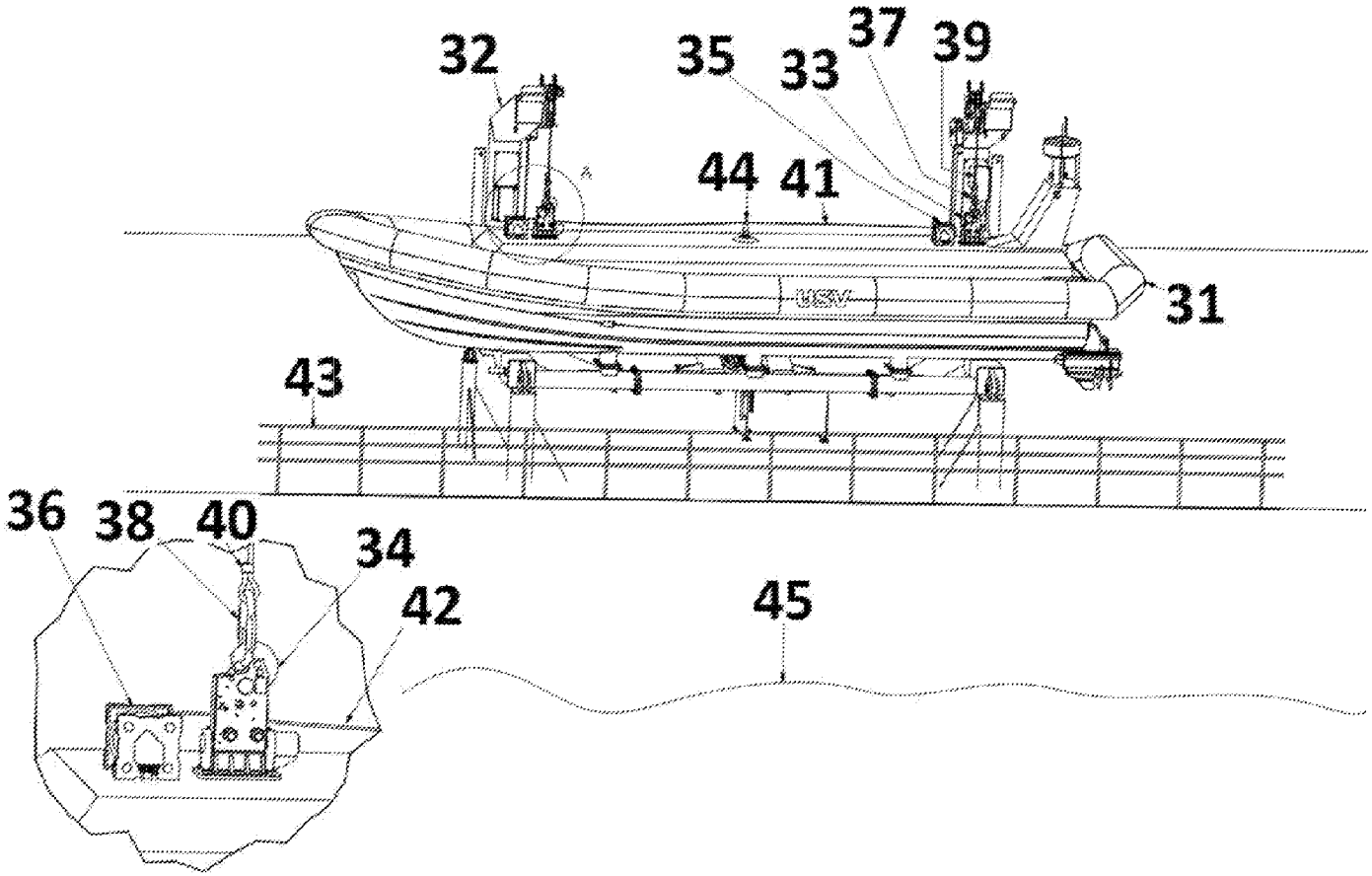
FIG. 9: Shows one embodiment of a system according to the invention.
Figure 10:
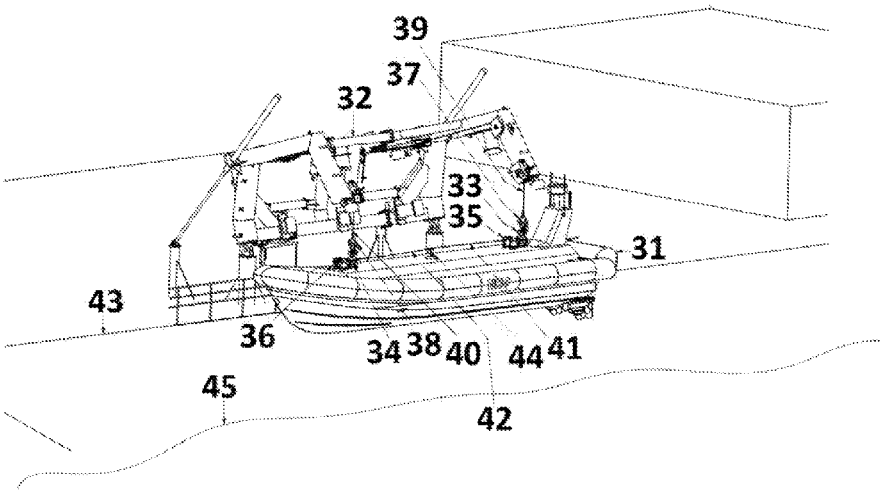
FIG. 10: Shows a system as illustrated in FIG. 9, where the vessel is being lifted out of its cradle.
Figure 11:
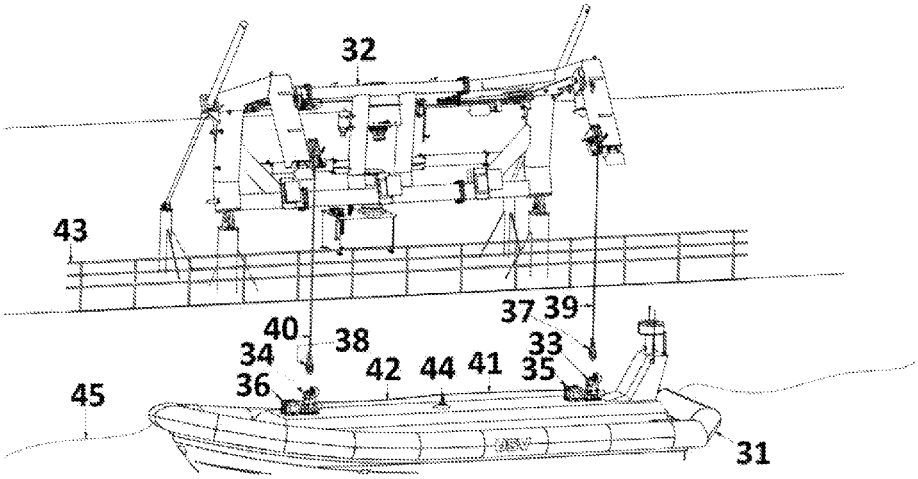
FIG. 11: Shows a system as illustrated in FIG. 9, where the vessel is being launched.
Figure 12:
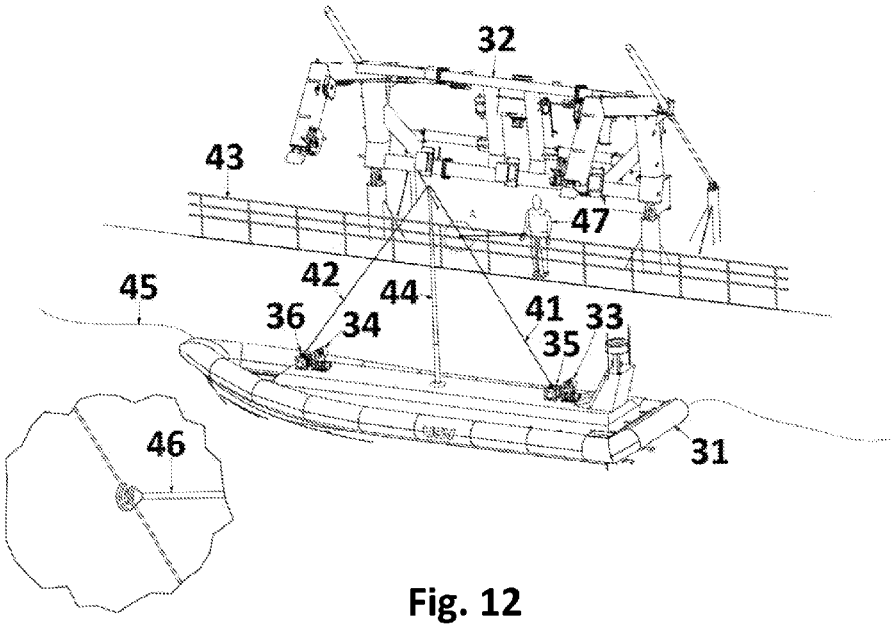
FIG. 12: Shows the recovery of a vessel using a system illustrated in FIG. 9.
Figure 13:
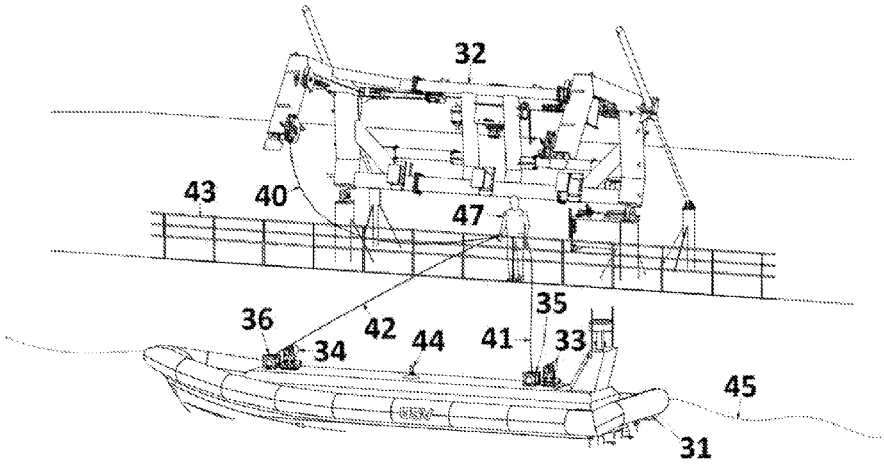
FIG. 13: Shows the recovery of a vessel using a system illustrated in FIG. 9.
Figure 14:
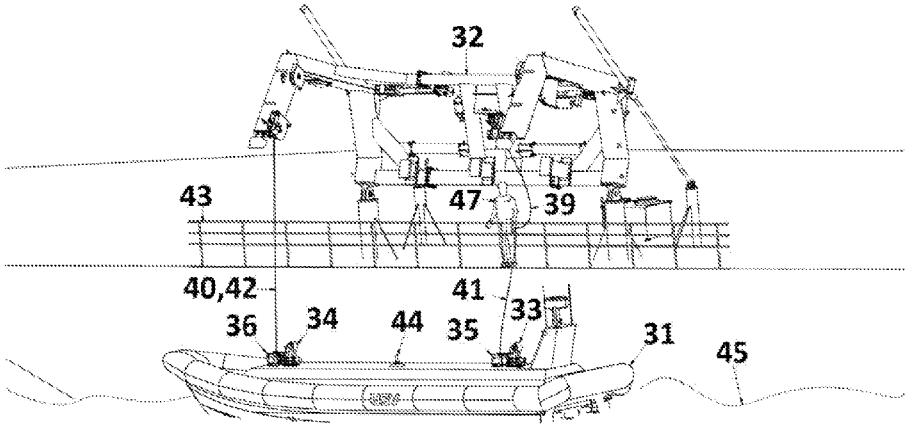
FIG. 14: Shows the recovery of a vessel using a system illustrated in FIG. 9.
Figure 15:
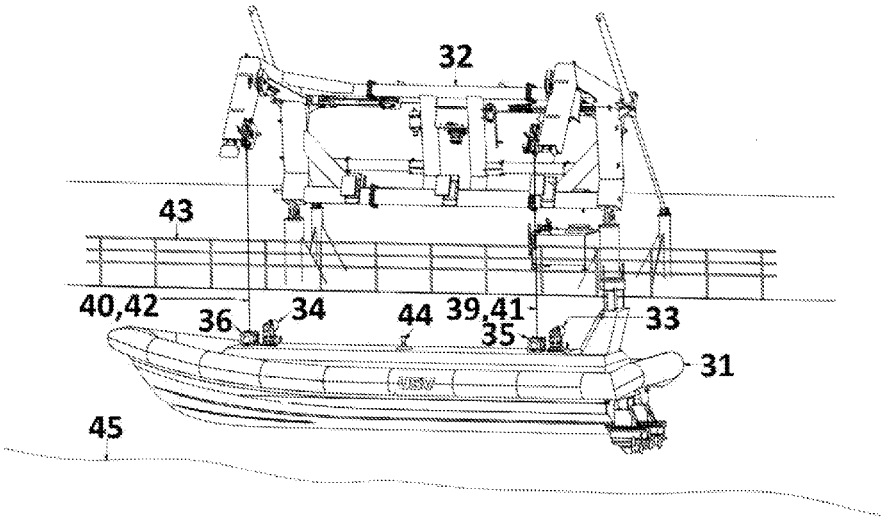
FIG. 15: Shows the recovery of a vessel using a system illustrated in FIG. 9.

The twin point system, see FIG. 9-15, comprises a ship or platform (43) having a davit (32) or crane mounted on the deck, and a vessel (31) to be launched from, or recovered by, said ship or platform. The davit (32) or crane comprises two lifting cables (39, 40), with lifting rings (37, 38), and a cradle. The vessel (31), see FIGS. 7 and 8, comprises two lifting winches (35, 34), with lifting winch cables (41, 42) and two off-load hooks (33, 36), and a telescopic mast (44).

Thus, the single point system consists of an off-load hook (3) which is placed approximately above the center of gravity (COG), the lifting cable has a lifting ring(8) at the end which is attached to the offload hook. The off-load hook (3) is automatically activated as the boat approaches the water surface (16). Also during the launch a painter line (10) must be attached using a painter ring (8) into a painter hook (4). The painter line system acts as a towing cable during launch. The painter hook is of an on-load type and is automatically activated.

A critical part of the invention is the mast (14) system, which can be designed as a flip up system, a telescope system or an inflatable system. The mast (14) is erected as the USV (1) is approaching the ship (13) for recovery. From the top of the mast (14) there is a line, lifting winch cable (11), down to the lifting winch (5) or drum. Also the system may consist of a second line running from the top of the mast (14) or from a connection point on the lifting winch cable to the painter winch (6), this line is called painter winch cable (12). The mast (14) system can be placed anywhere on the USV (1) as long as it can stretch out the lifting winch cable (11), and the painter winch cable.

The lifting winch (5) functions as a spring mounted winch with a constant pull, the lifting winch cable (11) is placed partly on the lifting winch (5). When the lifting winch cable (11) is connected to the lifting cable (9), and the davit (2) starts pulling the lifting cable (9), the lifting winch (5) will release the lifting winch cable (11) until the lifting winch cable (11) comes to the end. The lifting winch is dimensioned so that it can take the full load of the USV (1) as the UUV (1) is lifted out of the water.

The painter winch (6) functions as a spring mounted winch with a constant pull, the painter winch cable (12) is placed partly on the painter winch (6). When the painter winch cable (12) is connected to the painter line (10) and the ship (13) starts pulling the painter line (10) the painter winch (6) will release the painter winch cable (12) until the painter winch cable (12) comes to the end. The painter winch is dimensioned so that it can take the full towing load of the USV (1) as it is being towed through the water by the ship (13).

The boat hook (17) is typically a long telescopic rod with a hook or a mechanism to catch a rope at the end.

The twin point system functions in much the same manner as the single point system. There are however two main differences; the painter winch and painter hook is not needed, and the two sets of lifting winches and off-load hooks are mounted on separate sides of the center of gravity of the water vessel.

The method for launch and recovery of an unmanned vessel according to the present invention, wherein the vessel only has one lifting winch and one off-load hook mounted at or above the center of gravity of the vessel, i.e. a single point system, comprises the following three steps:

1. Preparation Before the Launch of USV (Single Point System)

Before commencing the launch procedure the recovery system must be prepared, this involves rigging of the mast (14) and attaching the lifting winch cable (11) and the painter winch cable (12).

2. Launch of the USV (Single Point System)

During the typical launch procedure the USV (1) is made ready and the lifting ring (7) is attached into the off-load hook (3). At the same time the painter ring (8) is attached into the painter hook (4). The USV (1) is then lifted out of its cradle using the davit (2) and then swung out over the side of the ship (13). The USV (1) is then lowered down towards the water surface (16). The off-load hook (3) is automatically activated as the boat approaches the water surface (16). As soon as the water surface (16) lifts the USV (1) the offload hook will then release, and the lifting ring (7) and lifting cable(9) is lifted away from the USV (1) using the davit (2).

The USV is now in a towing position and the USV (1) must then start its engine, and must be steered into position. As soon as the operator has control of the USV (1) the painter hook (4) can be released/activated and the USV is free to start its mission.

3. Recovery of the USV (Single Point System)

Commencing the recovery the USV (1) is maneuvered close to the ship (13). The mast is then erected and this stretches out the lifting winch cable (11) and the painter winch cable (12). As the USV (1) maneuvers close to the ship (13) the lifting winch cable (11) or the painter winch cable (12) is within the reach of a crew (18) member and his boat hook (17). The crew (18) member will then catch the extended lifting winch cable (11) using the boat hook (17). He will then pull the lifting cable (12) towards him selves and then get hold of the end point of the lifting winch cable (11) and the end of the painter winch cable (12). He will then first connect the painter winch cable (12) to the painter line (10), before he connects the lifting winch cable (11) to the lifting cable (9). The painter line (10) will then be tightened so that the USV (1) is positioned directly below the davit (2) head when the propulsion is released on the USV (1).

The davit (2) can then start to pull in the lifting cable (9), this will wind out the lifting winch cable (11) from the lifting winch (5). As the lifting winch cable (11) comes to the end, the USV (1) will be lifted out of the water, and then placed in the lifting cradle.

The method for launch and recovery of an unmanned vessel according to the present invention, wherein the vessel has one lifting winch and one off-load hook mounted at one side of the center of gravity of the vessel and one lifting winch and one off-load hook mounted at the opposite side of the center of gravity of the vessel, i.e. a twin point system, comprises the following three steps:

1. Preparation Before the Launch of USV (Twin Point System)

Before commencing the launch procedure the recovery system must be prepared, this involves rigging of the mast (44) and attaching the lifting winch cables (41, 42).

2. Launch of the USV (Twin Point System)

During the typical launch procedure the USV (31) is made ready and the lifting ring fwd (38) and lifting ring aft (37) is attached into the off-load hook aft (33) and off-load hook fwd (34). The USV (31) is then lifted out of its cradle using the davit (32) and then swung out over the side of the ship (43). The USV (31) is then lowered down towards the water surface (45). The off-load hook aft (33) is automatically activated as the boat approaches the water surface (45). As soon as the water surface (45) lifts the USV (31) the offload hook aft (33) will then release, and the lifting ring aft (37) and lifting cable aft (39) is lifted away from the USV (31) using the davit (32). At the same time the propulsion of the USV (31) must start, and must be steered into position underneath the davit (32). As soon as the operator has control of the USV (31) the off-load hook fwd (34) can be released/activated and the USV (31) is free to start its mission.

The system can also be set up so that both hooks (33, 34) release at the same time.

3. Recovery of USV (Twin Point System)

Commencing the recovery the USV (31) is maneuvered close to the ship (43). The mast (44) or masts is then erected and this stretches out the winch cable fwd (42) and winch cable aft (41)). As the USV (31) maneuvers close to the ship (43) the winch cable aft (41) or winch cable fwd (42) is within the reach of a crew (47) member and his boat hook (46). The crew (47) member will then catch the extended winch cable aft (41) or winch cable fwd (42) using the boat hook (46). He will then pull the winch cable (fwd or aft) towards him selves. He will then first connect the lifting cable fwd (40) to the winch cable (fwd) before he connects the lifting cable aft (39) to the winch cable aft (41). The lifting cable fwd (40) will then be tightening so that the USV (31) is positioned directly below the davit (32) head when the propulsion is released on the USV (31).

The davit (32) can then start to pull in the lifting cable (fwd and aft), this will wind out the lifting winch cable (fwd and aft) from the lifting winch (fwd and aft). As the winch cable (aft and fwd) comes to the end the USV (31) will be lifted out of the water and then placed in the lifting cradle.

Although the detailed embodiments of the present invention all use off-load hooks for launching the vessel, this is not a prerequisite. Other types of fastening means which can be remotely activated such as on-load hooks, off-load hooks etc. may also be used.

The invention claimed is:

1. A system for launch and recovery of a vessel from a host ship or platform, said host ship or platform comprising a lifting davit or crane having at least one first lifting cable, wherein the vessel comprises at least one cable fastener releasably connectable to said at least one first lifting cable, and at least one lifting winch comprising a second lifting winch cable, and at least one mast system comprising a mast connected to at least one lifting winch by one end of the corresponding second lifting winch cable, said mast system being configured to raise the connected end of the second lifting winch cable in a vertical direction for capture from the host ship or platform and connection to the first lifting cable, the vessel being configured to be lifted out of the water suspended by the second lifting cable.

2. A system according to claim 1, wherein the vessel is an unmanned water vessel.

3. A system according to claim 1, the vessel comprising one fastener and one lifting winch having a second lifting winch cable mounted approximately at or above the center of gravity of the vessel.

4. A system according to claim 1, comprising one fastener and one lifting winch having a second lifting winch cable mounted on one side of the center of gravity of the vessel, and one fastener and one lifting winch having a second lifting winch cable mounted at the opposite side, in a horizontal direction, of the center of gravity of the vessel.

5. A system according to claim 1, wherein the mast system comprises at least one mast having a first and a second end, the mast being connected to a lifting winch by a second lifting winch cable, the second winch cable being fastened to the mast at a point closer to the first end than to the second end, the second end being mounted in a vertically pivotal manner on the vessel.

6. A system according to claim 1, wherein the mast system comprises a vertically extendable telescopic mast.

7. A system according to claim 1, wherein the fastener is an on-load hook or an off-load hook.

8. A system according to claim 1, comprising a painter winch with a painter winch cable, and an on-load hook, both of which are mounted near the bow or stern of said vessel.

9. A system according to claim 8, wherein the painter winch cable of the painter winch is connected to the mast system or the second lifting winch cable.

10. A method for launching a vessel from a host ship or platform, comprising the following steps:

attaching at least one lifting cable from a lifting davit or crane mounted on a host ship or platform, to at least one off-load hook on the vessel;

attaching a painter line to a painter on-load hook on the vessel;

lowering the vessel to the water surface, causing at least one off-load hook to release;

activating a painter on-load hook when the vessel is free from the off-load hook.

11. A method for recovering a vessel from a host ship or platform comprising the following steps:

maneuvering the vessel to within reach of a boat hook from the host ship or platform;

activating a mast system, causing at least one lifting winch cable, connected to a lifting winch to be raised;

manually capturing the at least one lifting winch cable connecting the at least one lifting winch cable to at least one lifting cable from a lifting davit or crane mounted on the host ship or platform;

lifting the vessel out of the water using the lifting davit or crane, wherein a painter cable connected to a painter winch is raised and captured along with the lifting winch cable and is connected to a painter line connected to the host ship or platform.

12. A system according to claim 5, wherein the fastener is an on-load hook or an off-load hook.

13. A system according to claim 3, wherein the mast system comprises at least one mast having a first and a second end, the mast being connected to a lifting winch by a second lifting winch cable, the second lifting winch cable being fastened to the mast at a point closer to the first end than to the second end, the second end being mounted in a vertically pivotal manner on the vessel.

14. A system according to claim 3, wherein the mast system comprises a vertically extendable telescopic mast.

15. A system according to claim 3, wherein the fastener is an on-load hook or an off-load hook.

16. A system according to claim 3, the vessel comprising a painter winch with a painter winch cable, and an on-load hook, both of which are mounted near the bow or stern of said vessel.

17. A system according to claim 2, wherein the unmanned water vessel comprises one of an USV (unmanned surface vessel) or an UUV (unmanned underwater vehicle).

18. A system according to claim 4, wherein the mast system comprises at least one mast having a first and a second end, the mast being connected to a lifting winch by a second lifting winch cable, the second lifting winch cable being fastened to the mast at a point closer to the first end than to the second end, the second end being mounted in a vertically pivotal manner on the vessel.

19. A system according to claim 4, wherein the mast system comprises a vertically extendable telescopic mast.

* * * * *